United States Patent [19]

Roeder

[11] Patent Number: 4,477,234

[45] Date of Patent: Oct. 16, 1984

[54] DOUBLE ACTING ENGINE AND PUMP

[76] Inventor: George K. Roeder, P.O. Box 4335, Odessa, Tex. 79760

[21] Appl. No.: 416,996

[22] Filed: Sep. 13, 1982

[51] Int. Cl.[3] ..... F04B 47/08

[52] U.S. Cl. ..... 417/393; 417/563; 417/571

[58] Field of Search ..... 417/393, 404, 563, 567, 417/571; 91/313

[56] References Cited

U.S. PATENT DOCUMENTS

| | | | |
|---|---|---|---|
| 2,046,834 | 7/1936 | Murphy | 417/563 X |
| 2,799,225 | 7/1957 | Schoen | 417/567 X |
| 2,948,224 | 8/1960 | Bailey et al. | 417/393 |
| 3,849,030 | 11/1974 | McArthur et al. | 417/393 |

*Primary Examiner*—Leonard E. Smith
*Attorney, Agent, or Firm*—Marcus L. Bates

[57] ABSTRACT

A double acting hydraulically actuated pump and engine valve assembly for use downhole in a borehole for producing fossil fuel therefrom. High pressure hydraulic power fluid is forced downhole to a special control valve means located between opposed engine pistons. The valve means causes the power fluid to apply an alternating force to confronting faces of the pistons, while the opposed faces of the spaced apart pistons serve to pump and force production fluid to flow from a production zone, upward to the surface. The pump assembly can be used in combination with existing bottom hole assemblies, fixed or free type, already installed downhole in the wellbore.

10 Claims, 13 Drawing Figures

DOUBLE ACTING ENGINE AND PUMP

BACKGROUND OF THE INVENTION

Fluid operated downhole pumps for deep oil wells are known to those skilled in the art as evidenced by the Roeder U.S. Pat. No. 3,453,963, Roeder U.S. Pat. No. 3,703,926, and McArthur U.S. Pat. No. 3,849,030. In the recited Roeder U.S. Pat. No. 3,453,963, there is set forth a double acting pump having an engine spaced from the production pump. Roeder also mentions a valve assembly operating between pistons which are connected together by a control connecting rod having undercut areas formed thereon for supplying fluid to shift the main valve. Accordingly, the up and down sliding movement by the connecting rod occurs inside a control sleeve, such as discussed in Roeder and later on exemplified by the McArthur patent. In both the prior art Roeder and McArthur patents, the connecting rod is provided with an undercut area which functions to operate a main valve located between the opposed engine pistons. The undercut area reduces the tensile strength of the connecting rod and introduces a weakened area which is prone to fracture and break.

Roeder U.S. Pat. No. 3,703,926 illustrates a production piston or plunger which sucks in formation fluid under the production piston on the upstroke and forces the fluid out on the downstroke.

It is often desirable to fabricate the engine and pump pistons as large as possible while making the connecting rod as small as possible so as to achieve a maximum effective piston area. The connecting rod which rigidly connects together the two engine pistons is drastically weakened when provided with an undercut area for engine valve operation. In order to eliminate undercutting the piston connecting rod, the present invention provides a valve assembly unique in design because the main control valve is actuated by fluid flow directed by a pilot control valve rod, and the rod is mechanically actuated by contact made by each end by the engine pistons and more particularly by the exhausting chamber side of the pistons. The main control valve allows power fluid to pass into the high pressure chamber while exhausting spent power fluid out through the center portion of the main control valve. High pressure power fluid never enters the inside portion of the main control valve. This unique pump assembly includes means by which high pressure fluid alternately contacts alternate areas of the main control valve, while the small end is constantly subjected to low pressure fluid on each stroke of the rod system. The main control valve moves in phase with the connecting rod movement. Accordingly, after the main control valve moves to the up position, the rod system is forced up, and after the main control valve moves to the down position, the rod system is forced down. The exhausting side of the engine piston contacts the pilot rod, pushing it into position to either release high pressure fluid above the main control valve or to provide a passage for high pressure to enter above the large area of the main control valve.

The provision of the above improved hydraulically actuated pump assembly enables the incorporation of a new intake and exhaust valve system into the apparatus. Accordingly, the present improvement in downhole pumps provides an engine which can transmit greater forces towards the pumping action each reciprocation of the engine thereof, and furthermore provides improved flow passageways through which the production fluid can flow.

SUMMARY OF THE INVENTION

This invention relates to a hydraulically actuated downhole pump assembly which has a pair of pistons arranged on opposed sides of an engine valve assembly. The confronting sides of the pistons serve as the engine piston while the opposed sides of the pistons serve as the pump pistons. A rigid connecting rod of uniform diameter interconnects the spaced apart pistons. The engine valve assembly is controlled by means of a separate pilot control rod. The inside portion of the main control valve slidably works on the outside diameter of the connecting rod while exhausting spent power fluid out through the center of the opposite portion of the main control valve. Each time the engine pistons reciprocate, the main control valve moves in phase and directionally portional to that of the connecting rod, and alternate ends of the engine valve assembly are alternately subjected to power oil so that the pressure thereof holds the pilot control rod in the proper position by the pressure differential on each end.

The above improvements enable a new intake exhaust valve system to be used in conjunction with the engine and pump which provides a maximum area for flow of fluid therethrough. Moveover, the pilot control rod of the valve assembly eliminates the need for forming undercut or flat areas on the connecting rod, thereby resulting in a rigid connecting rod of improved structural integrity.

The before mentioned pressure differential is effected across the pilot control rod which holds the rod in proper position, which prevents the rod from drifting away from its operating position, and also provides a means to continually replace any high pressure power fluid which may be lost by leakage, thereby forcing the main valve to always remain in one of its desired alternate positions once it has been shifted.

The valve assembly is provided with means by which high pressure fluid is continually discharged from one side of the pilot control rod so that the pilot control rod cannot possibly shift or move from either of its alternate positions during operation of the pump.

More specifically, in the preferred embodiment of the present invention, the valve assembly is connected to a source of power fluid, and includes passageways which flow directly from the valve assembly into working chambers of the engine. A power control rod extends through the valve assembly and includes opposed marginal terminal ends which reside within one of the engine working chambers. The pilot control rod is always reciprocated along the longitudinal axial centerline of the engine into one of its alternate positions. This action causes power fluid to be conducted into one of the engine chambers, while spent power fluid is conducted from the other engine chamber, and when the control rod is reciprocated into the alternate position, the relationship of the power fluid and spent power fluid flow reverses respective to the engine working chambers.

When the engine piston reciprocates or strokes into one of its alternate positions, the control rod moves in proportion thereto, or in the same direction of the engine connecting rod. Movement of the pilot control rod is achieved by the piston contacting the upper end of the pilot rod, whereupon the pilot rod is pushed down, thereby closing off one of the ports and opening an alternate port.

The pilot control rod is moved to its alternate position by the lower piston which contacts the lower end of the pilot rod as it nears the top end of its stroke and forces the pilot rod to move up thereby closing and opening, respectively, the ports leading to the upper and lower power chambers, respectively, so that the engine piston is forced by the power oil to continue to stroke in the opposite direction.

A primary object of the present invention is the provision of a double acting engine and pump combination having a valve assembly located between spaced pistons, with there being a connecting rod directly connecting the pistons together, and with the connecting rod having a constant diameter portion which extends through the valve assembly and which has a regular outer surface undisturbed by flats, grooves, and the like so that the connecting rod has the highest possible strength.

Another object of the present invention is the provision of an improved intake exhaust valve system which provides an unusually large fluid flow passageway through which produced fluid is conducted.

A further object of this invention is the provision of a bumper type pilot control rod for operation of a valve assembly which eliminates the need of using flats and undercut areas on the connecting rod so that the rod can develop the maximum possible structural integrity.

A still further object of this invention is the provision of a pressure locking means for a pilot control rod which is held in position by the pressure differential effected thereacross and thereby cannot drift away from its intended operating position.

Another and still further object of this invention is the provision of a power controlled, power operated valve assembly having provisions by which power oil continually biases the control rod towards the proper operating position, thereby preventing movement of the control rod from its intended position, and wherein the power oil is continually replaced to therefore maintain the rod biased into the desired position.

An additional object of this invention is the provision of a pilot control rod operated valve assembly having an operating chamber from which a continuous discharge of high pressure fluid occurs so that the main control valve is always biased into its desired operating configuration.

A still further object of this invention is the provision of a control valve system having a main control valve which is moved in response to and in the same direction of the rod system.

Another and still further object of this invention is the provision of a hydraulically actuated downhole pump having a valve system which is moved between two alternate positions in response to reciprocal motion of the engine pistons thereof, and wherein the main control valve has an annular area through which spent power fluid flows out of the pump.

An additional object of this invention is the provision of a valve assembly for a double ended hydraulically actuated engine which includes a pilot control rod actuated valve assembly operated between alternate positions for use in a cavity located downhole in a wellbore.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
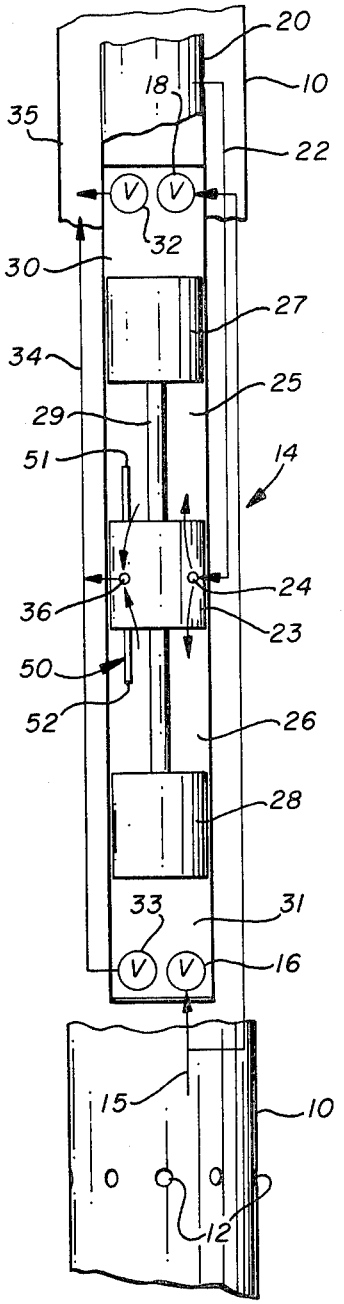
FIG. 1 is a fragmentary, broken, schematical representation of a downhole hydraulically actuated pump apparatus made in accordance with the present invention.

In FIG. 1 of the drawings, there is schematically disclosed a cased borehole, part of which is generally illustrated by the Numeral 10, which extends downhole through a hydrocarbon containing formation (not shown). Perforations 12 communicate the interior of the casing with the payzone. A pump 14, made in accordance with the present invention, has an intake at 15 which is submerged into the liquid hydrocarbons contained within the bottom of the wellbore. Production valves 16 and 18 permit one way flow of production or formation fluid into the pump apparatus.

Power fluid is conducted down a central power oil tubing 20 and flows along a flow path 22, usually formed externally of the pump cavity, in a manner previously set forth in my issued U.S. Pat. Nos. 3,957,400 and 3,915,595. Valve assembly 23, made in accordance with the present invention, controls the flow of power fluid entering at 24 into engine working chambers 25 and 26. Pistons 27 and 28 serve the dual function of engine and production pump pistons. The pistons have confronting faces which form a reciprocating closure member for the working chambers 25 and 26, and further include opposed faces which provide for pumping of production cylinders 30 and 31. The pistons are rigidly connected together for slidable movement by means of a connecting rod 29. The connecting rod connects pistons 27 and 28 to one another and has the illustrated medial portion thereof slidably received through the axial centerline of the valve assembly.

Produced fluid valves 32 and 33 are connected to expel production into the annulus 35, where the fluid flows up the annulus and to the surface of the ground.

The engine valve assembly includes a spent power fluid outlet 36 which exhausts into passageway 34 and comingles with the production fluid as the produced fluid flows uphole towards the surface of the ground.

Figure 2:
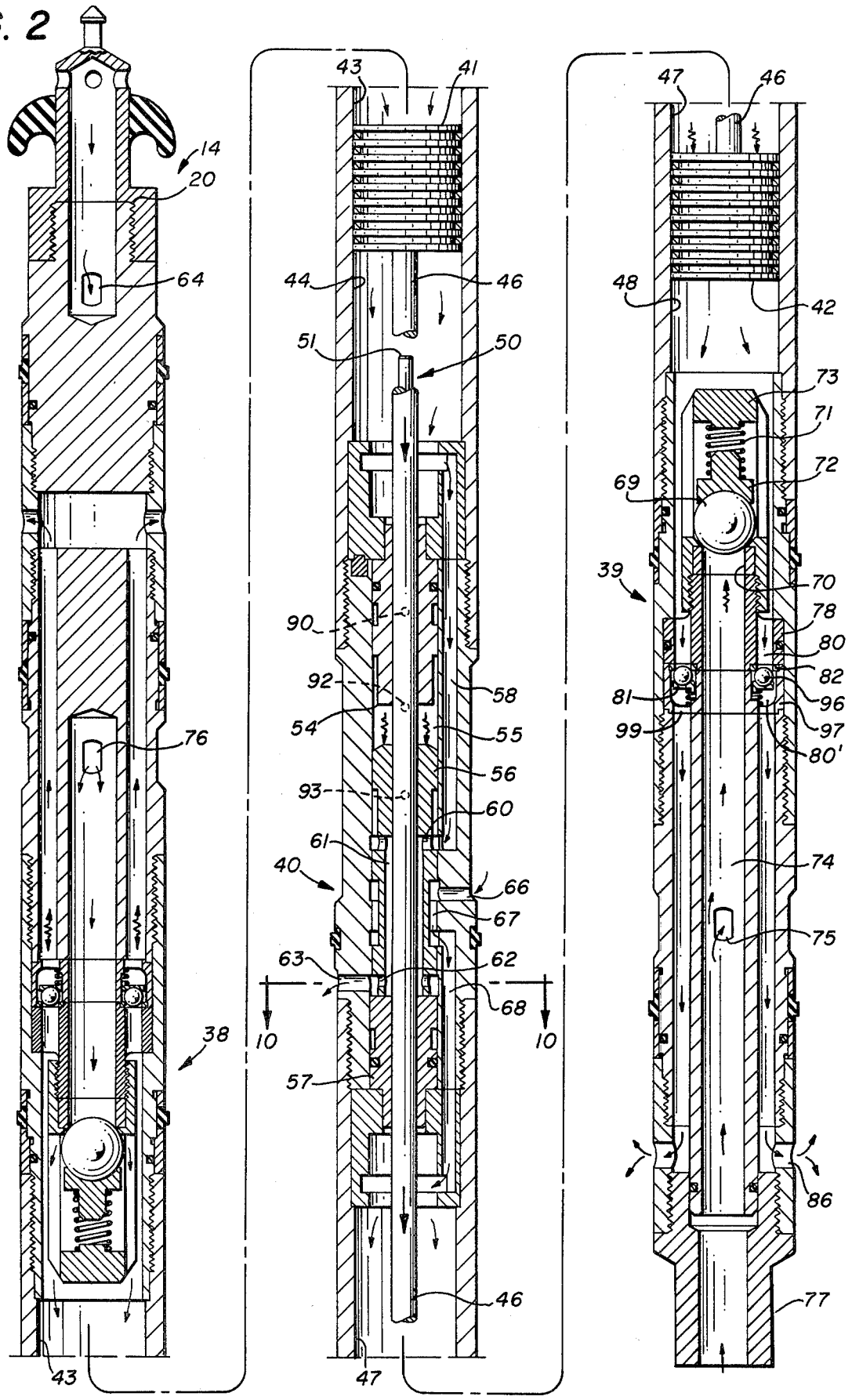
FIG. 2 is a longitudinal, part cross-sectional view of a pump device made in accordance with some of the teachings of FIG. 1.
Figure 5:
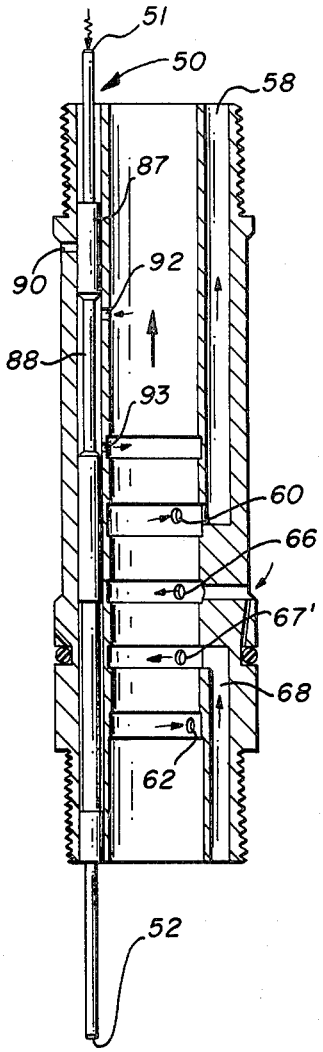
FIG. 5 is similar to FIG. 4 and shows the apparatus in an alternate position.
Figure 6:
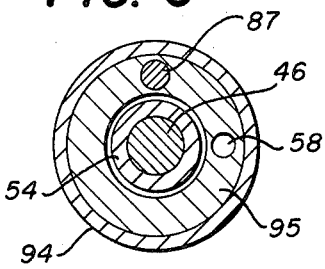
FIGS. 6, 7, 8, and 9, respectively, are cross-sectional views taken along lines 6—6, 7—7, 8—8, and 9—9, respectively, of FIG. 3.
Figure 7:
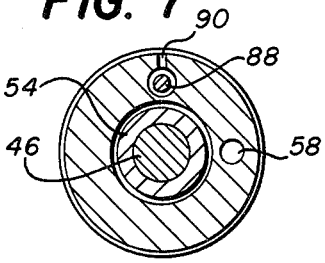
Figure 8:
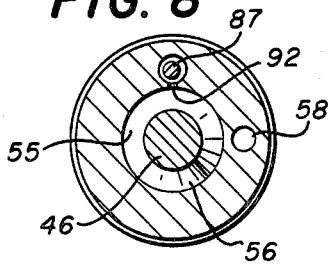
Figure 9:
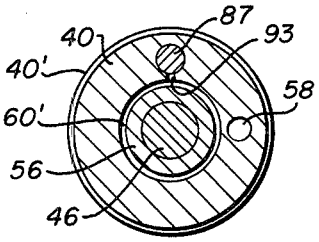
Figure 10:
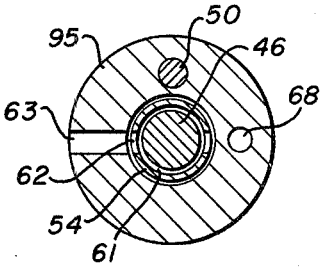
FIG. 10 is a cross-sectional view taken along line 10—10 of FIG. 2.
Figure 11:
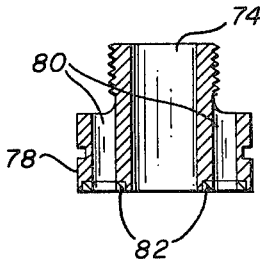
FIG. 11 is an isolated, detail of part of the apparatus previously disclosed in FIG. 2.
Figure 12:
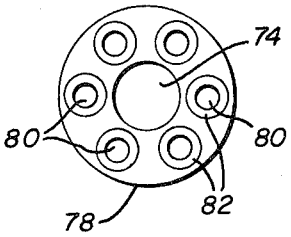
FIG. 12 is an end view of part of the apparatus disclosed in FIG. 11; and, FIG. 13 is a longitudinal cross-sectional view of the apparatus shown in FIG. 12.
Figure 13:
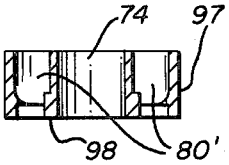

In FIG. 2, there is disclosed an upper production valve assembly 38 located within the upper marginal end of the pump assembly, a lower production valve assembly 39, located within the lower marginal end of the pump assembly, and an engine valve assembly located in a medial body portion of the pump assembly. The apparatus includes an upper pump piston face 41, a lower pump piston face 42, which reciprocatingly cooperate with the illustrated pump barrel to provide an upper piston production chamber 43 and a lower piston production chamber 48. Connecting rod 46 preferably is of constant diameter, and interconnects the two pistons together. The lower engine chamber 47 is separated from the lower production chamber 48 by the lower piston.

Figure 3:
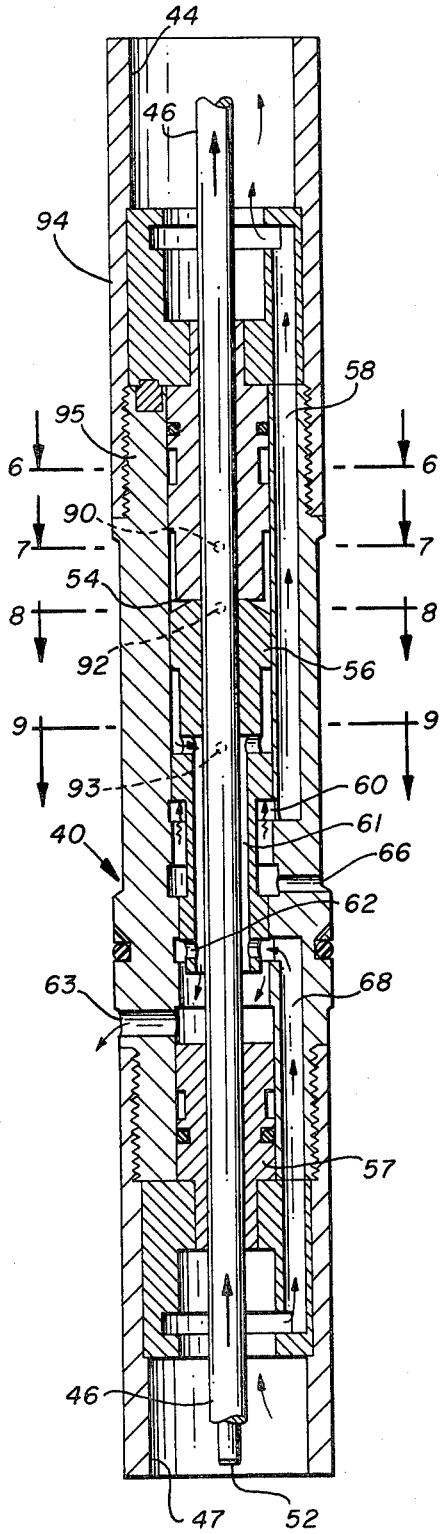
FIG. 3 is an isolated, detailed, part cross-sectional view of the valve assembly of the pump device illustrated in FIG. 2.
Figure 4:
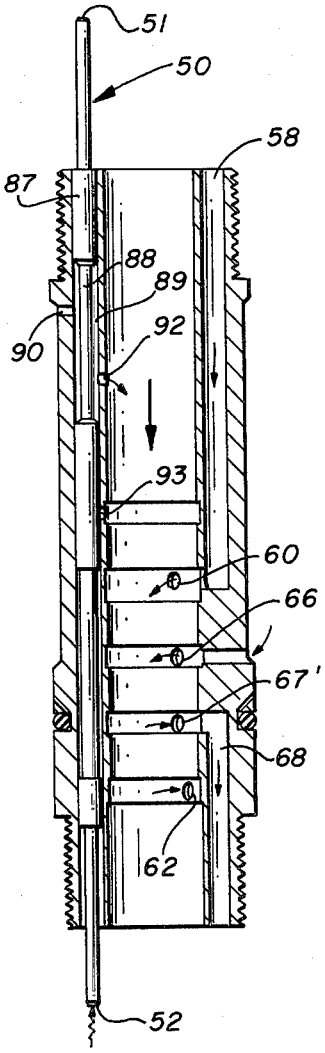
FIG. 4 is a detailed, part cross-sectional view of part of the pump device seen in FIG. 3.

A power control rod 50 is provided with an upper terminal end 51 which extends into the upper engine chamber 44. As seen in FIG. 4, the rod has a lower end 52. In FIG. 3, there is disclosed an upper seal assembly 54 which sealingly engages the rod. In FIG. 2, annulus 55 is formed between the connecting rod and the valve housing.

In FIGS. 2 and 3, flow control valve element 56 is concentrically arranged respective to the connecting rod and the outer pump housing. Number 57 indicates a lower seal assembly.

Passageway 58 connects the upper engine chamber 44 alternately to a source of power fluid and to exhaust. Numeral 60 indicates a port which is actuated from closed to open by means of the element 56. Annulus 61 communicates with port 62 of the valve element. Exhaust port 63 forms a spent power fluid outlet, and is connected to passageways 58 and 68 when the valve element 56 is in the illustrated position of FIG. 3. As best seen illustrated in FIG. 2, power fluid enters at the upper packer connector 20, flows through lateral port 64, and into the power fluid inlet 66 of the valve assembly. The power fluid flows along annulus 67 and into a power fluid passageway 68.

In FIG. 2, the production valve assembly includes a large ball 69 which is biased onto a seat 70 by the illustrated spring 71. The spring is held captured within follower 72, all of which is assembled within cage 73. Formation fluid flows at 74 into port 75 which leads to upper formation fluid inlet port 76.

The suction or lower end 77 of the pump assembly is suitably provided with a seating means and is flow connected to a source of formation fluid. Produced fluid at passageways 80 is forced to flow through the production valve assemblies 81 and 82 and along the fluid flow passageway 84 to the production outlet 86, where the fluid then flows back up the annulus to the surface of the ground.

As seen illustrated in FIGS. 3–10, the pilot rod has spaced apart enlargements 87, and is reduced at medial portion 88. Annulus 89 is formed between the two enlargements and about the reduced medial portion 88.

As seen in FIGS. 3 and 4, power fluid inlet 90 is connected to power fluid outlet 92 when reduced portion 88 of the control rod is in the position of FIG. 4. Numeral 93 indicates a spent fluid port which is covered or sealed off by the lower enlargement 87'.

Cylindrical barrel 94 is opposed to a similar cylindrical barrel, and the barrels are spaced from one another by the valve assembly of the present invention.

Ball 96 is captured within cage 97 in a manner similar to my issued U.S. Pat. No. 4,032,266. Bottom face 98 of cage 97 forms a number of parallel ports which are in communication with the illustrated parallel passageways 99. The last named passageway leads to outlet 86, and enables produced fluid to flow up the borehole or casing annulus to the surface of the ground.

OPERATION

In operation, the downhole hydraulically actuated pump apparatus is provided with a packer nose assembly at 20 and circulated downhole to the bottom of a borehole, where the pump is seated within a cavity, such as exemplified, for example, in my issued U.S. Pat. Nos. 3,517,741 and 3,627,048. Power oil is forced down the power oil string where the power oil flows at 22 into the power oil inlet 24 of valve assembly 14. The power oil is conducted by the valve assembly alternately into chambers 25 and 26, while at the same time, spent power oil is exhausted from the other of chambers 25 and 26. The spent power oil exits at port 36, and flows along with the production fluid up passageway 34 and into the annulus 35 formed between casing 10 and power oil string 20. The produced fluid and spent power fluid flows to the surface of the ground where it is gathered by conventional means.

As the pistons are reciprocated by extracting power from the power oil, fluid from a hydrocarbon containing formation (not shown) flows into the perforations 12 of casing 10, and along flow path 15 where the fluid is conducted into intake valve 16; and at the same time fluid flows along the illustrated passageway into intake valve assembly 18. Reciprocation of the engine forces fluid through production outlet or exhaust valves 32 and 33, where the fluid flows along the before described path upward towards the surface of the ground.

The present invention can be used in conjunction with both fixed and free-type downhole pump assemblies in accordance with the teachings of my previously issued U.S. Pat. Nos. 3,957,400 and 3,974,878.

In FIGS. 1–4, together with the other figures of the drawings, those skilled in the art, having digested the above descriptive matter, will now appreciate that the engine pistons bump the pilot control rod near the end of either up or down stroke, and that the pilot rod is held in position by the operating pressure. As particularly seen disclosed in FIG. 2, the opposed terminal ends 51 and 52 of the pilot control rod are moved in the same direction of travel in response to movement of connecting rod 29. Accordingly, when piston 28 contacts terminal end 52 of control rod 50, the rod is moved in the same direction of travel of the pistons, and the engine valve assembly is shifted so that power oil flows into chamber 26 while chamber 25 is connected to exhaust port 36. This action provides upthrust on the pilot rod due to there being power oil at 26 and spent power fluid at 25, which action produces a pressure differential across the pilot rod. Accordingly, should leakage occur within the engine valve operating system, the power fluid will be continuously replaced, while the spent power fluid will continue to exhaust at port 68.

When the engine reaches the end of its upstroke, the pilot rod is shifted into its alternate position, whereupon power oil is applied within engine working chamber 25, while spent power oil is exhausted from engine chamber 26, and now the pilot rod is biased into the opposite direction in the above described manner.

Looking more specifically at the details of the operation of the downhole pump assembly as set forth in FIGS. 1 and 2, power fluid flows into sub 20, through lateral port 64, along a passageway of the pump cavity, and into power fluid inlet port 66. The valve element 56 has been shifted into its downward most position thereby communicating power oil inlet port 66 with passageway 68, and accordingly, power fluid is effected within chamber 47. At the same time, chamber 44 is connected to passageway 58, port 60 of the traveling valve element, annulus 61, port 62, and exhaust port 63. Accordingly, the pilot rod, which has just been moved upwards by the action of the engine, is now continuously biased in an upward direction due to the before mentioned pressure differential placed thereacross. As power oil effected at 47 forces the lower piston downward, formation fluid which previously was sucked into chamber 48 now is forced to flow through the radial ball check valve 81, 82 and out production port 86. At the same time production fluid is ingested through the lower production end 77, through the lateral port 75, up a passageway formed within the pump cavity, into lateral port 76, through the large upper axial ball and seat, where production fluid is sucked into the upper chamber 43. The engine next reverses direction, and as the upper piston travels upwards, the upper piston will force formation fluid from cavity 43, through the upper radial ball and seat assembly, out of the valve 32, and up to the surface of the ground.

It should be noted that the pilot valve is forced to stay in the upward position by the pressure effected within chamber 47. Power oil is constantly replacing any lost fluid from the annulus located about the traveling valve element, noting that continual flow is possible through port 90 and through port 92 by flowing through the reduced diameter marginal portion of the pilot rod which exists between the top and center seal areas of the pilot rod.

As the pump completes the downstroke, the upper piston contacts the upper end of the pilot rod and pushes the rod down, thereby closing off port 90 and opening port 93. There is now communication effected from 92 to port 93, as best seen illustrated in FIG. 5. This action relieves the pressure above the large end of the main valve. The high pressure fluid entering the engine valve assembly through port 66 forces the valve element to move upwards and maintains this position so long as fluid is exhausted from chamber 55 by means of flow path 92 to 93 and out of 62, as best seen illustrated in FIGS. 2, 3, 4, and 5. Power fluid effected within the lower engine cylinder continues to hold the pilot valve in the upward position.

As the engine valve 56 moves into its uppermost position, ports 66 and 60 are opened whereby flow can occur into chamber 25, thereby allowing high pressure fluid to act on the lower side of the upper engine piston. This action forces the pistons upward, which in turn forces formation fluid, previously drawn into production chamber 30 during the downstroke, to flow out of the exhaust check valves 32.

As the power fluid forces the upper engine piston upwards, the spent power fluid is forced from the chamber 47 into passageway 68 where the spent power fluid moves through the ported traveling valve element and out of the pump by means of exhaust port 63. During this upward movement of the lower piston, production fluid is drawn into the chamber located below the piston, and during this same upward movement of the rod system, fluid previously sucked into the upper production chamber during the downstroke is now forced out through the upper production ports. During this time the moving piston contacts the lower end of the pilot rod as it nears the top end of the stroke, thereby forcing the pilot rod to move up. This action closes port 93 and opens port 90 to chamber 55, so that the power fluid now flows into the power fluid inlet port 66.

The power fluid which continually exerts a force against the lower large outside diameter portion of the main valve is overcome by the larger force acting against the larger top end of the valve element 56, and thereby forces the valve element down as a result of the differential in the applied forces, and as a result of the pilot rod having been moved as previously described. The operating engine assembly continues to reciprocate the pistons in the above described manner.

The valve system of this invention containing the intake check valves 16 and 18 are made much larger in size when using an equally large flow passageway to thereby allow ample flow of incoming fluid without restrictions or curves or turns which contribute to pressure drop during the entire life of the downhole pump assembly. The series of exhaust check valves are of smaller effective area as compared to the effective area of the intake valve for the reason that it is much easier to force fluid under pressure out of a hole as compared to the upper limits when sucking fluid through a hole.

I claim:

1. In a downhole hydraulically actuated pump having an engine section, a valve section, and pump section connected together to form an elongated pump assembly by which power fluid under relatively high pressure flows downhole into a borehole to the valve section which conducts the power fluid into the engine section, thereby reciprocating an engine piston, while concurrently spent power fluid flows from the engine, through the valve section and along a return flow path to the surface of the earth; with there being a formation fluid passageway connected to the downhole pump so that when the pump is reciprocated by the engine, formation fluid is forced along said return path to the surface of the earth; said valve section is positioned intermediate an upper and lower cylinder, there being an upper and lower piston reciprocatingly received within said upper and lower cylinder, the upper piston divides the upper cylinder into a pump cylinder and an engine cylinder, while the lower piston divides the lower cylinder into a pump and engine cylinder; with the engine working chambers being adjacent the valve section and the pump working chambers being opposed to one another and located at the extremity of the pump section, and further including a production valve assembly located at each extremity of said pump section for controlling the flow of formation fluid into and out of the pump working cylinders, the improvement comprising:

a connecting rod by which said upper and lower pistons are rigidly connected to one another; said valve sections includes a valve element which is reciprocatingly shifted from one to another of two alternant positions in response to reciprocation of a control rod from one to another of two alternate positions; said control rod extends through said valve section in parallel relationship respective to said connecting rod, and includes opposed marginal ends which extend into the upper and lower engine working chambers;

said control rod is reciprocatingly positioned within the valve section to be abuttingly engaged by the confronting faces of the adjacent pistons, and thereby alternately moved from one position of operation to an alternant position of operation in response to abutting engagement with said pistons;

said cylinders, pistons, connecting rod, and valve element have a common axial centerline; the medial length of said connecting rod which extends through said valve section can be made a constant diameter to thereby provide maximum structural integrity;

said valve element is connected to receive a pressure differential thereacross in response to movement of the control rod so that the valve element shifts between the recited alternant positions of operation in response to said control rod being shifted in response to movement of the connecting rod;

passageway means by which said valve element conducts power fluid to one of the engine working chambers and conducts spent power fluid from the other of said engine working chambers, and when the pistons engage and shift the control rod, the valve element shifts to an alternant position, thereby reversing the relationship of the power fluid and spent power fluid flowing to the upper and lower engine working chambers;

and valve means at opposed ends of the pump assembly by which formation fluid flows to and production fluid flows from the pump section.

2. The improvement of claim 1 wherein the valve means located at each end of the production chambers includes a production valve assembly having a relatively large axial passageway and a relatively large ball check valve seated therein by which production fluid flow into the chamber is controlled;

a plurality of radially spaced apart relatively smaller ball check valves seated within a plurality of radially spaced apart longitudinally extending passageways located about said axial passageway by which fluid flow from the pump working chamber is controlled.

3. The improvement of claim 2 wherein said connecting rod is of substantially uniform and constant diameter between the spaced pistons.

4. The improvement of claim 3 wherein said control rod is moved in the same direction of travel as the connecting rod, while the valve element is moved in an opposite direction respective thereto;

and said control rod is biased into the desired position of operation by a pressure differential placed thereacross so that the control rod cannot possibily shift to the alternant position until contacted by and moved by a piston.

5. A fluid operated pump assembly for operation downhole in a well and adapted to receive power fluid conveyed from the surface of the ground, downwardly to the pump assembly, conveys spent power fluid upwardly to the surface, and to lift fluid produced by the well upwardly to the surface; the pump assembly having a valve section, an engine section, and a pump section all connected together with the valve section controlling the flow of power fluid into the engine to thereby enable the engine to extract power from the fluid, and with there being connected means by which the engine section drives the pump section to enable the pump to perform the stated function of lifting fluid upwardly; the improvement comprising:

said engine section including spaced apart cylinders each having a piston reciprocatingly received therein, said pistons being connected together by a solid connecting rod, there being a common axial centerline respective to said pistons, cylinders, and rod; each piston is arranged to have adjacent faces and opposed faces; each piston divides a cylinder into a pump chamber and an engine chamber;

the valve section being located between the cylinders, the engine chambers being located between the pistons and the valve section, the pump section being located at opposed ends of the spaced cylinders;

a control rod having a central axis spaced from the connecting rod axis, said control rod reciprocatingly extending through said valve section and including opposed marginal free ends which extend into the opposed engine chambers, said opposed ends are arranged to be moved by alternate engagement with a piston so that the control rod is shifted into one of two alternant positions in response to movement of the connecting rod;

said valve section includes a flow control valve element concentrically arranged respective to a medial part of said piston connecting rod and adapted to reciprocate between alternant positions in response to movement of said control rod;

said control rod, when shifted into one of the alternant positions, causes the valve element to move into a position to conduct power fluid into a lower engine chamber while an upper engine chamber exhausts spent power fluid therefrom; said control rod, when shifted into the other of the alternant positions, causes the valve element to move into a position to conduct spent power fluid from a lower engine chamber while power fluid is conducted to the upper engine chamber;

and means by which said control rod and valve element are arranged respective to the other components of the pump assembly such that the marginal ends of the control rod are subjected to the power fluid in one engine chamber and spent power fluid in the other engine chamber to thereby provide a pressure differential across the control rod for biasing the control rod into the proper position of operation.

6. The improvement of claim 5 wherein said valve section includes a power fluid inlet, and a power fluid outlet, means by which said valve element is reciprocated in response to the reciprocating movement of said control rod causing pressure differential of power fluid and spent power fluid to be effected thereacross;

flow ports and passageway means connecting said engine chambers and valve element to the power fluid inlet and spent power fluid exhaust, said valve element, when moved to one of two alternant positions of travel, forms flow paths by which power fluid flows from the power fluid inlet, through valve section, and into one engine cylinder chamber, and exhausts through the exhaust port; and, when the traveling valve element is moved to the alternant position, the relationship of power and spent power fluid flow respective to the engine chambers is reversed.

7. The improvement of claim 5 wherein the lower pump chamber of said pump section has an intake valve in the form of a ball check valve, an axial passageway connected to the ball check valve seat, and inlet sub at the end of the axial passageway through which production fluid flows; an outlet port formed in the axial passageway upstream of said ball check valve;

the upper pump chamber of said pump section has an intake valve in the form of a ball check valve, an axial passageway connected to the ball check valve seat, a port formed in the last said axial passageway which can be connected to the port formed in the first recited axial passageway so that one way flow formation fluid is available for flow into each pump chamber;

an annulus is formed about said axial passageway at each of the opposed ends of the pump section; an outlet check valve, including a plurality of radially spaced ball check valves and seats, are positioned within said annulus for controlling flow of production fluid from the pump section.

8. The improvement of claim 5 wherein said connecting rod is of substantially uniform and constant diameter between the spaced pistons, to thereby enable the connecting rod to have maximum structural integrity.

9. The improvement of claim 8 wherein the lower pump chamber of said pump section includes an intake valve assembly in the form of a ball check valve, an axial passageway connected to the ball check valve seat, an inlet sub at the end of the axial passageway through which production fluid flows; a formation outlet port formed in the axial passageway upstream of said ball check valve;

the upper pump chamber of said pump section includes an intake valve assembly in the form of a ball check valve, an axial passageway connected to the ball check valve seat, an inlet sub at the end of the axial passageway through which production fluid flows; a formation outlet port formed in the axial passageway upstream of said ball check valve;

the upper pump chamber of said pump section includes an intake valve assembly in the form of a ball check valve, an axial passageway connected to the ball check valve seat, a port formed in the last said axial passageway which can be connected to the port formed in the first recited axial passageway so that formation fluid is available at each pump chamber.

10. The improvement of claim 9 wherein an annulus is formed about said axial passageway at each of the pump chambers, an outlet check valve including a plurality of radially spaced ball check valves and seats which are positioned within said annulus for controlling flow of production fluid from the pump section.

* * * * *

UNITED STATES PATENT AND TRADEMARK OFFICE

CERTIFICATE OF CORRECTION

PATENT NO. : 4,477,234

DATED : October 16, 1984

INVENTOR(S) : George K. Roeder

It is certified that error appears in the above-identified patent and that said Letters Patent is hereby corrected as shown below:

Column 1, line 16, Substitute --of-- for "by";
Line 40, substitute --of-- for "by".
Column 5, line 68, substitute --of the control rod-- for "87'".
Column 6, line 48, insert --the-- after "either";
Line 64, substitute --passage-- for "port".
Column 7, line 64, delete "the" after from;
Column 9, line 67, substitute --connecting-- for "connected".

Signed and Sealed this

*Sixteenth* Day of *July 1985*

[SEAL]

*Attest:*

DONALD J. QUIGG

*Attesting Officer* *Acting Commissioner of Patents and Trademarks*